US012070795B2

(12) United States Patent
Bresciani

(10) Patent No.: US 12,070,795 B2
(45) Date of Patent: Aug. 27, 2024

(54) DIE CASTING MACHINE

(71) Applicant: ITALPRESSEGAUSS S.P.A., Capriano del Colle (IT)

(72) Inventor: Michele Bresciani, Capriano del Colle (IT)

(73) Assignee: ITALPRESSEGAUSS S.P.A., Capriano del Colle (IT)

( * ) Notice: Subject to any disclaimer, the term of this patent is extended or adjusted under 35 U.S.C. 154(b) by 0 days.

(21) Appl. No.: 18/550,524

(22) PCT Filed: Mar. 9, 2022

(86) PCT No.: PCT/IB2022/052093

§ 371 (c)(1),
(2) Date: Sep. 14, 2023

(87) PCT Pub. No.: WO2022/195406

PCT Pub. Date: Sep. 22, 2022

(65) Prior Publication Data

US 2024/0189893 A1 Jun. 13, 2024

(30) Foreign Application Priority Data

Mar. 15, 2021 (IT) ..... 102021000006101

(51) Int. Cl.
*B22D 17/10* (2006.01)
*B22D 17/26* (2006.01)

(52) U.S. Cl.
CPC ..... *B22D 17/26* (2013.01)

(58) Field of Classification Search
CPC ..... B22D 17/02; B22D 17/08; B22D 17/10; B22D 17/26; B22D 17/266
USPC ..... 164/303, 312
See application file for complete search history.

(56) References Cited

U.S. PATENT DOCUMENTS

| | | | | |
|---|---|---|---|---|
| 3,951,579 | A | 4/1976 | Myers et al. | |
| 4,080,144 | A | 3/1978 | Hehl | |
| 2007/0237851 | A1* | 10/2007 | Baron et al. | B22D 17/266 425/451.9 |
| 2017/0057142 | A1 | 3/2017 | Murata et al. | |

FOREIGN PATENT DOCUMENTS

| | | |
|---|---|---|
| CN | 205310731 U | 6/2016 |
| GB | 1537133 A | 12/1978 |

OTHER PUBLICATIONS

International Search Report for International Patent Application No. PCT/IB2022/052093, mailed Jun. 1, 2022, 10 pages.

* cited by examiner

*Primary Examiner* — Kevin P Kerns
(74) *Attorney, Agent, or Firm* — Armstrong Teasdale LLP

(57) ABSTRACT

Provided is a die-casting machine that provides connection between a horizontal column and a first fixed plane by a shaped section of the horizontal column. The shaped section of the horizontal column has a plurality of circumferential ribs radially projecting and axially spaced apart, interspersed with grooves.

10 Claims, 6 Drawing Sheets

DIE CASTING MACHINE

CROSS-REFERENCE TO RELATED APPLICATIONS

This application is a National Stage Application of International Patent Application No. PCT/IB2022/052093, having an International Filing Date of Mar. 9, 2022, which claims priority to Italian Application No. 102021000006101, filed Mar. 15, 2021, the entire contents of which are hereby incorporated by reference herein.

FIELD OF THE INVENTION

The present invention is in the field of die-casting machines, in particular for the die-casting of aluminum alloys and other metals, of the toggle or toggle-free type. In particular, the subject of the present invention is an innovative system for connecting the horizontal columns of the machine to the fixed plane.

BACKGROUND OF THE INVENTION

According to the solutions currently known, a die-casting machine comprises a base having a predefined longitudinal extension, on which a first fixed vertical plane and a second fixed vertical plane, longitudinally spaced from the first one, are mounted. Moreover, the machine provides a movable vertical plane placed between the fixed planes, which are translatable longitudinally.

The two fixed vertical planes are rigidly connected by horizontal columns and the movable plane is guided on the base and supported smoothly along the horizontal columns.

The first fixed plane carries a first half-die (which is therefore a fixed half-die) and the moving plane carries a second half-die (movable half-die); the half-dies are composed of two complementary parts that together define an imprint of the part to be obtained by die-casting.

The machine further comprises an injection unit for sending molten metal into the die when the two half-dies are coupled; the injection unit is supported by the base and placed in front of an outer face of the first fixed plane.

The movement and clamping of the movable plane with the first fixed plane are usually carried out using two technologies: the first involves the use of a hydraulic cylinder for movement and a toggle system for clamping (machines with toggle); the second involves the use of a hydraulic cylinder for movement and clamping jaws that lock onto the columns, arranged behind the movable plane, for locking (toggle-free machines).

In the machines with toggle, the horizontal columns are threaded at both ends to rigidly attach them to the first fixed plane on one side and to the second fixed plane on the other side.

In the toggle-free machines, the horizontal columns are threaded on one side to rigidly connect them to the first fixed plane and have a plurality of circumferential grooves in the central part onto which the clamping jaws engage. At the other end, the columns are either supported freely by the second fixed plane or clamped by means of a plate.

The connection between the horizontal columns and the first fixed plane is of enormous importance for the reliability of these machines, since said connection is subject to high and cyclic stresses.

In the state of the art die-casting machines are known wherein the problem of the connection between horizontal columns and the first fixed plane has been addressed. Documents GB-A-1537133 and U.S. Pat. No. 4,080,144 show die-casting machines wherein the column is secured to the fixed plane by means of a connecting device screwed to the column. Said machines are affected by problems such as play between the coupled surfaces and tight tolerances, in addition to the need to phase the column for screwing. Documents U.S. Pat. No. 3,951,579 and US-A1-2017/057142 show die-casting machines equipped with columns with shaped profiles. However, these machines have extremely complex coupling systems, which do not solve the problems of play between the coupled surfaces and do not ensure optimal column retention.

SUMMARY OF INVENTION

The object of the present invention is to provide a particularly reliable and structurally simple die-casting machine, in particular with reference to the connection between the horizontal columns and the first fixed plane. This object is achieved by a die-casting machine as described and claimed herein. Advantageous embodiments of the present invention are also described.

BRIEF DESCRIPTION OF THE DRAWINGS

The features and advantages of the method according to the present invention will be apparent from the description below, given by way of non-limiting example according to the figures in the attached drawings, wherein.

DETAILED DESCRIPTION OF THE INVENTION

Figure 1:
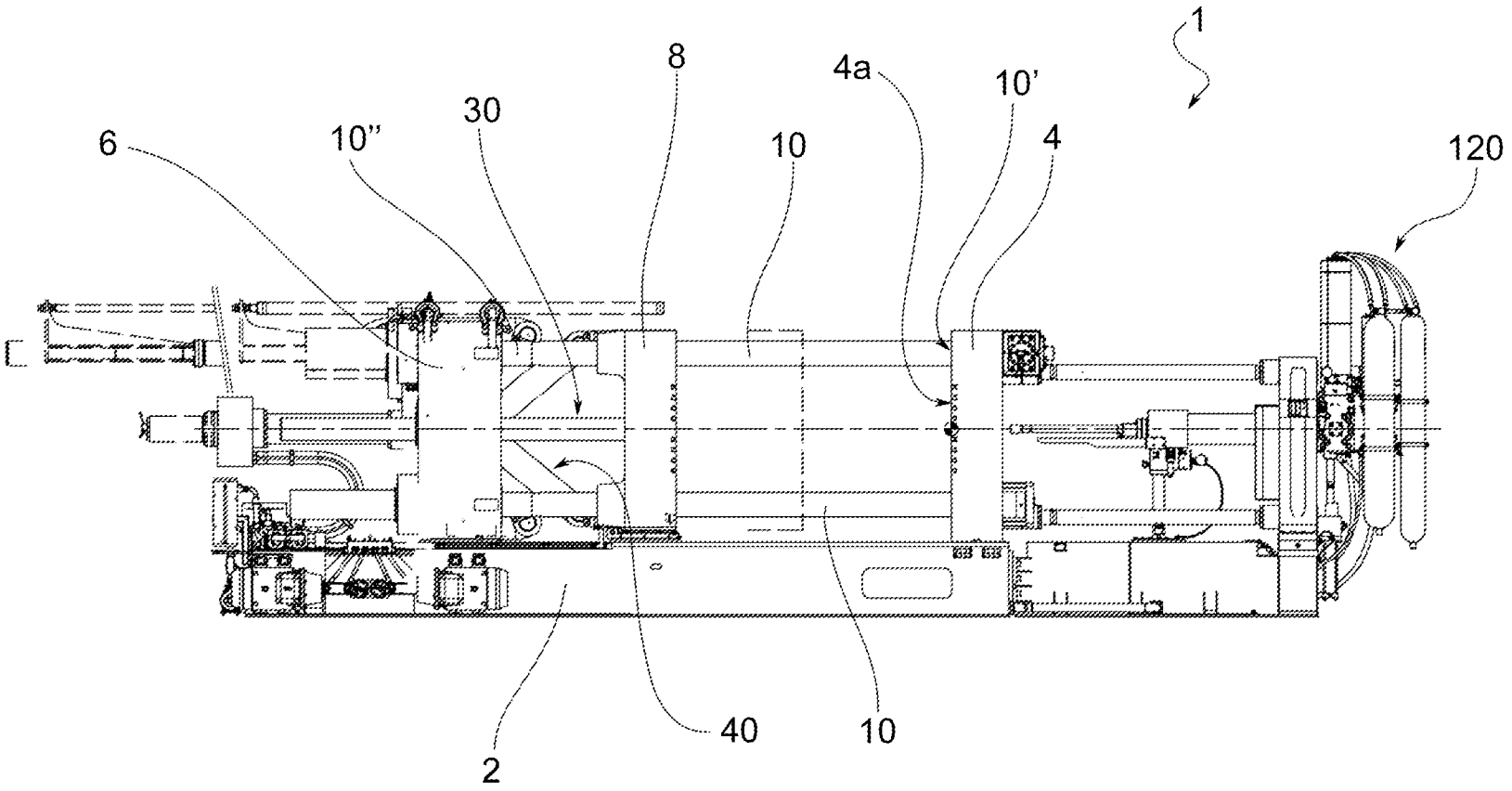
FIG. 1 shows a die-casting machine with toggle according to one aspect of the present invention.

With reference to FIG. 1, according to a first aspect of the invention, a die-casting machine with toggle comprises a base 2 extending longitudinally, a first fixed vertical plane 4, a second fixed vertical plane 6 spaced longitudinally from the first fixed plane 4, and a movable vertical plane 8 located between the fixed planes 4, 6 and horizontally translatable on command.

Preferably, the position of said second fixed plane is adjustable according to the height of the die.

The two fixed planes 4, 6 are rigidly joined by horizontal columns 10, usually consisting of one-piece steel cylinders, extending longitudinally; the movable plane 8 is guided on the base 2 and supported slidingly by the horizontal columns 10 to make a longitudinal movement to and from the first fixed plane 4.

An inner face 4*a* of the first fixed plane 4 carries a first half-die (or fixed half-die); an inner face 8*a* of the movable plane 8, facing the inner face 4*a* of the first fixed plane 4, carries a movable half-die. The two half-dies are made up of complementary parts which, when coupled, form a die, corresponding to the shape of the part to be obtained by die-casting.

The machine 1 further comprises an injection unit 120 for sending molten metal into the imprint of the die when the die is closed.

The machine 1 further comprises at least one hydraulic cylinder 30, for example arranged to pass through the second fixed plane 6, connected to the movable plane 8 for moving it longitudinally, and a toggle system 40, for example arranged between the second fixed plane 6 and the movable plane 8, for clamping the movable plane 8 in the engagement position with the first fixed plane 4, in which the die is closed.

Each horizontal column 10 extends longitudinally along a respective column axis X between a first end 10', secured to the first fixed plane 4, and a second end 10", attached to the second fixed plane 6.

Figure 2:
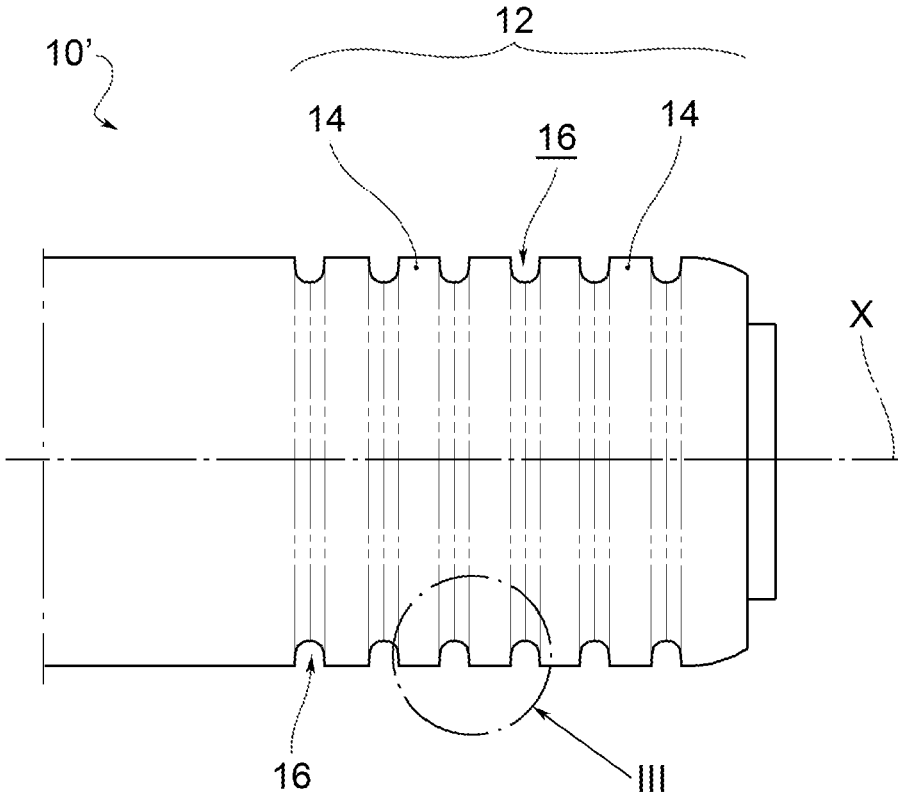
FIG. 2 depicts a first end of a horizontal column according to the invention.

According to the invention (FIGS. 2 and 3), at said first end 10', the horizontal column 10 has a shaped section 12 for connecting to the first fixed plane 4.

The shaped section 12 comprises a plurality of circumferential, radially projecting and axially spaced ribs 14 so as to form a respective groove 16 between two successive ribs.

Preferably, each groove 16 has a substantially trapezoidal profile 18. Said profile 18 has a first side 20 composed of a truncated cone surface coaxial to the column axis X, a groove bottom 22 composed of a cylindrical surface coaxial to the column axis X and a second side 24 composed of a further truncated cone surface coaxial to the column axis X, so that said sides 20, 24 are converging towards the column axis X.

Figure 3:
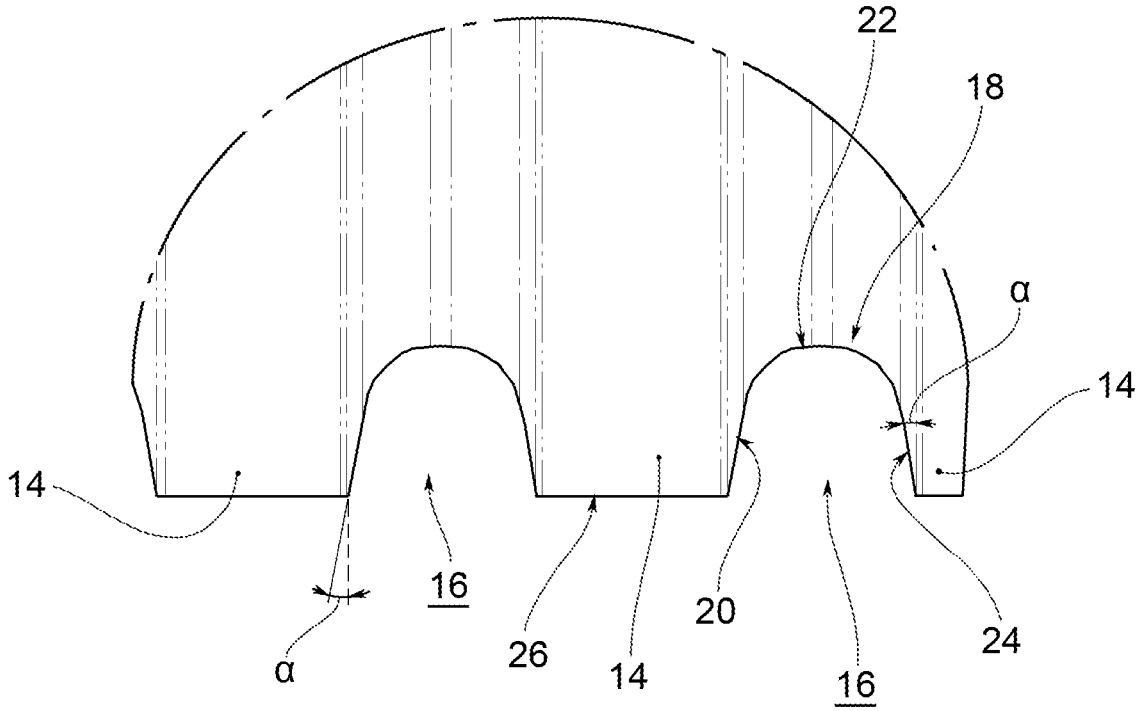
FIG. 3 is an enlargement of the box III in FIG. 2, showing an outline of a shaped section of the column.

According to an embodiment, each side 20, 24 is inclined with respect to the direction transverse to the column axis X, i.e., the radial direction, by an angle $\alpha$ between 6 degrees and 16 degrees, preferably between 8 degrees and 14 degrees, for example equal to 10 degrees (FIG. 3).

Preferably, moreover, the first side 20 and the groove bottom 22 are connected in such a way as to avoid the formation of areas in which stresses may be concentrated, such as the groove bottom 22 and the second side 24.

Consequently, each rib 14 is delimited on the sides by a first side 20 and a second side 24 of the grooves 16 and at the top by a ridge 26 consisting of a cylindrical circular surface, coaxial to the column axis X. The ridge 26 is connected to the first side 20 and the second side 24.

For connecting each column 10 to the first fixed plane 4, said first fixed plane 4 has a respective through hole 4*c*; the first end 10' of the column 10 is inserted into the hole 4*c*, so that the shaped section 12 protrudes externally.

The machine 1 comprises, for each column 10, a connection device adapted to be rigidly coupled to the shaped section 12 of the column 10 projecting from the first fixed plane 4, thereby forming an abutment which opposes the extraction of the column 10 from the first fixed plane 4.

Figure 5:
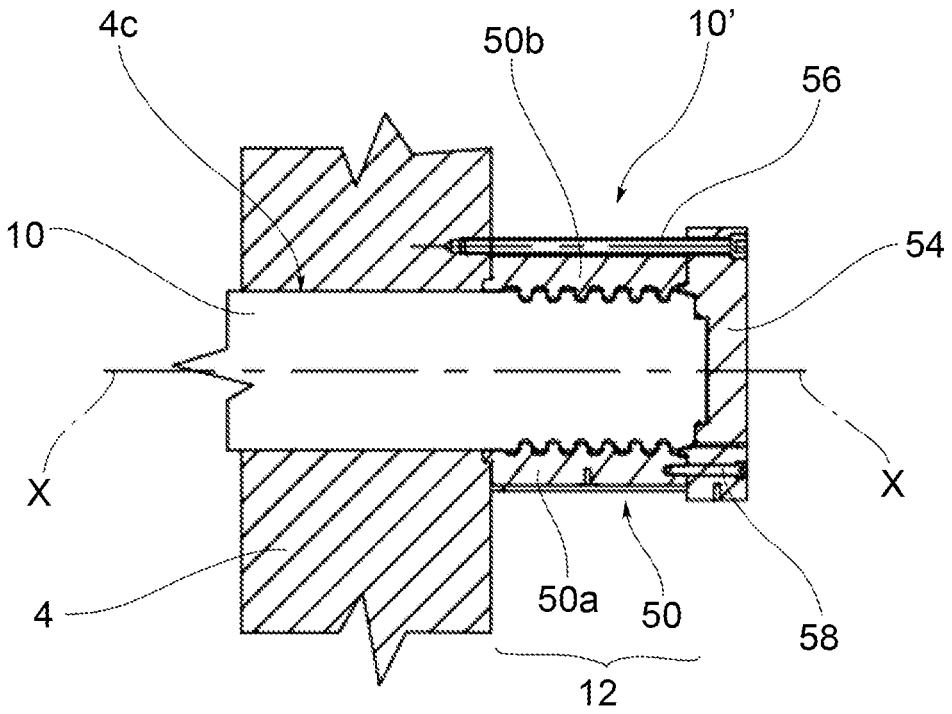
FIG. 5 is a cross-sectional view of the connection device of FIG. 4.
Figure 4:
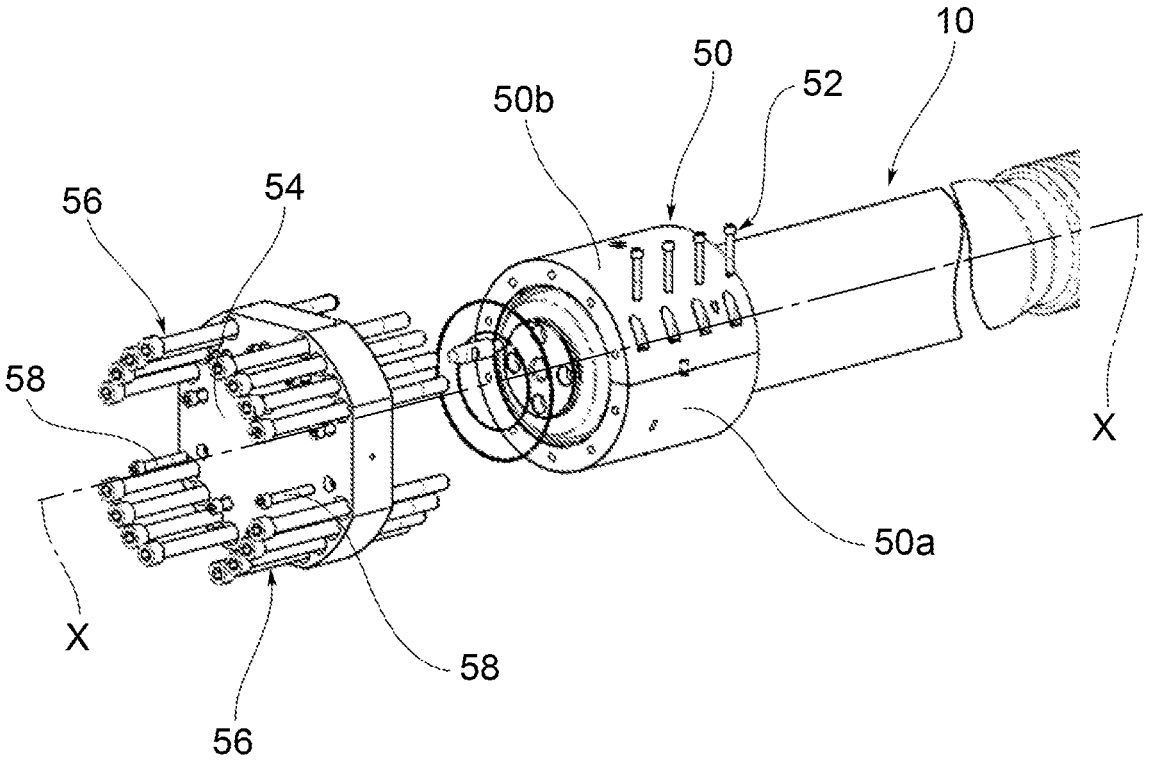
FIG. 4 depicts a device for connecting a column to a fixed plane of the machine, according to one embodiment of the invention.

The connecting device is manually operated and comprises a shell 50, adapted to be rigidly coupled with shape coupling to the shaped section 12 of the horizontal column 10. The shell 50 consists of two half-shells 50*a*, 50*b*, each in the form of a hollow half-cylinder, coupled to each other by a plurality of tangential screws 52 (FIG. 5).

Preferably, in addition, the connecting device comprises a main plate 54 that is abutted to the first end 10' of the column 10 and the shell 50. Preferably, said main plate 54 is attached by screws directly to the first fixed plane 4 via a plurality of first axial screws 56 and, further, secured to the shell 50 via a plurality of second axial screws 58. In said embodiment, the shell 50 is not directly secured to the first fixed plane 4.

Figure 6:
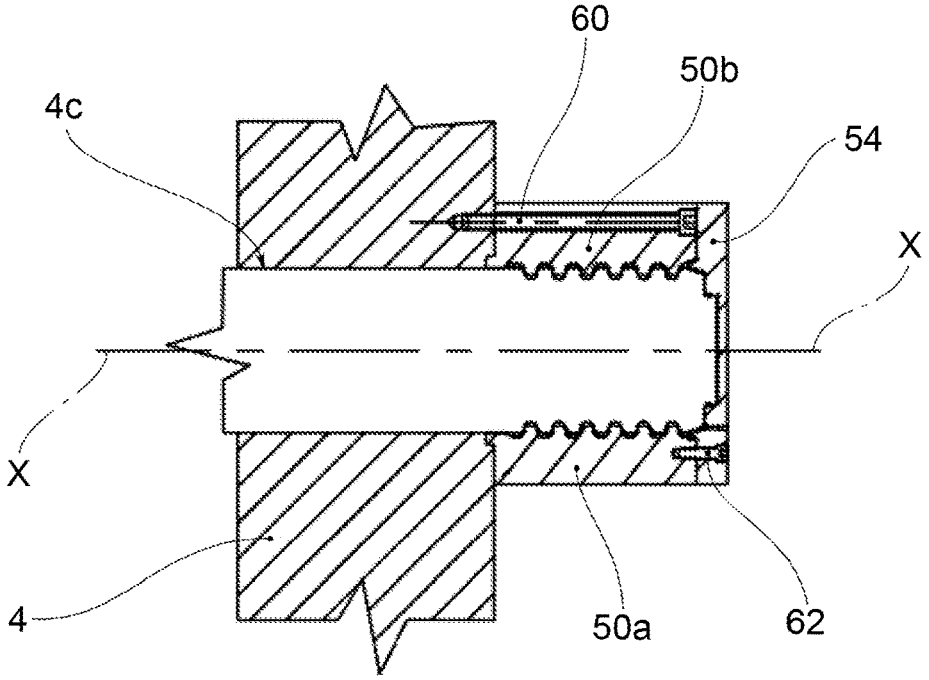
FIG. 6 is a cross-sectional view of a connection device, according to another embodiment of the invention.

According to another embodiment (FIG. 6), which is manually operated, the shell 50 is secured directly to the first fixed plane 4 by a plurality of first axial screws 60, and the main plate 54 is secured to the shell 50 by a plurality of second axial screws 62.

Figure 7:
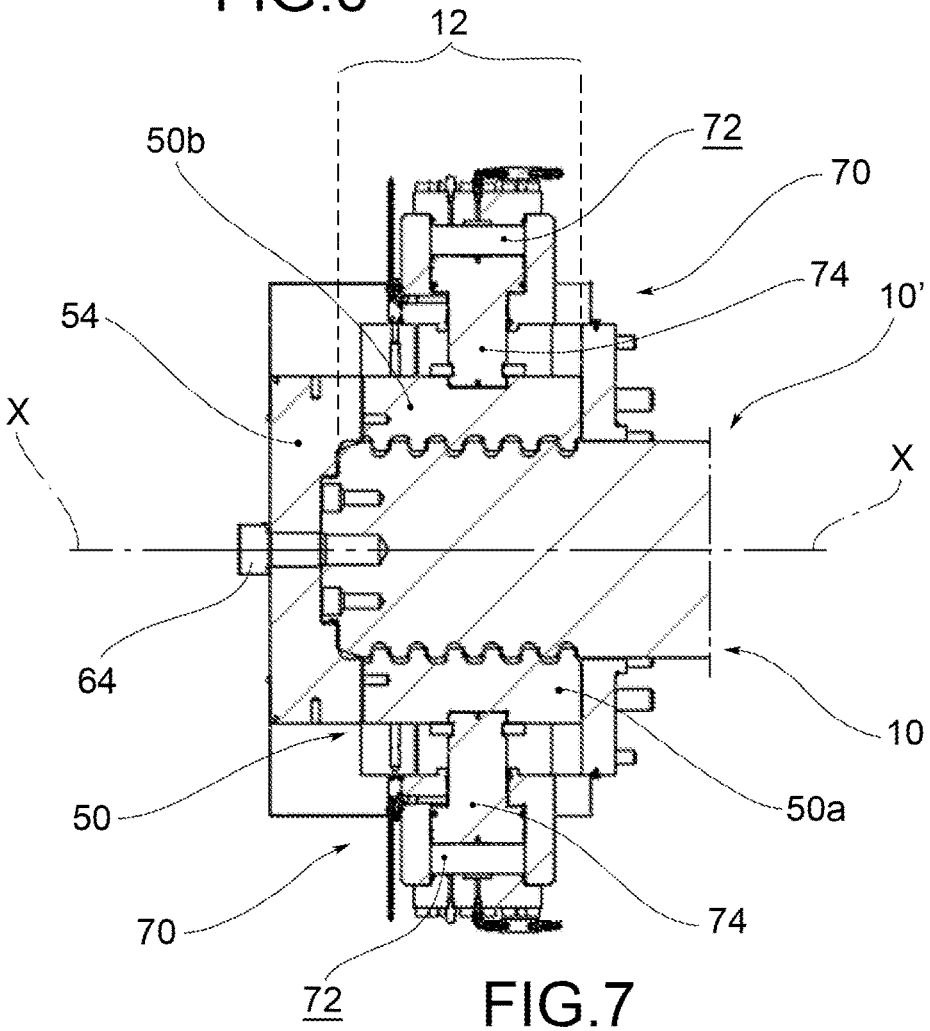
FIG. 7 is a cross-sectional view of a connection device, according to yet another embodiment of the invention.

According to yet another embodiment (FIG. 7), the connecting device is hydraulically or pneumatically operated, and comprises a shell 50, adapted to be rigidly coupled with form fitting to the shaped section 12 of the column 10. For example, the shell 50 consists of two half-shells 50*a*, 50*b*, which enclose the shaped section 12 like a jacket.

The connecting device further comprises a main plate 54, which is applied in abutment to the first end 10' of the column 10 and the shell 50. The main plate 54 is secured by screws 64 to the first end 10' of the column 10.

Further, the connecting device comprises at least one fluidly operable jaw 70 that is attached to the shell 50. Said jaw 70 has a pressure chamber 72 feedable with pressurized fluid and comprises at least one piston 74 operatively coupled to the respective pressure chamber 72 to be radially actuated and to operate in thrust on the respective half-shell 50*a*, 50*b*.

Preferably, a plurality of pistons 74 is provided, operating in radial opposition.

According to a variant of the invention, moreover, the shaped section with ribs and grooves as described above is provided at the second end 10" of the column 10 for connecting the column 10 to the second fixed plane 6. In said embodiment, the connecting device according to the embodiments described above actuates the connection between the second end 10" of the column 10 and the second fixed plane 6.

Figure 8:
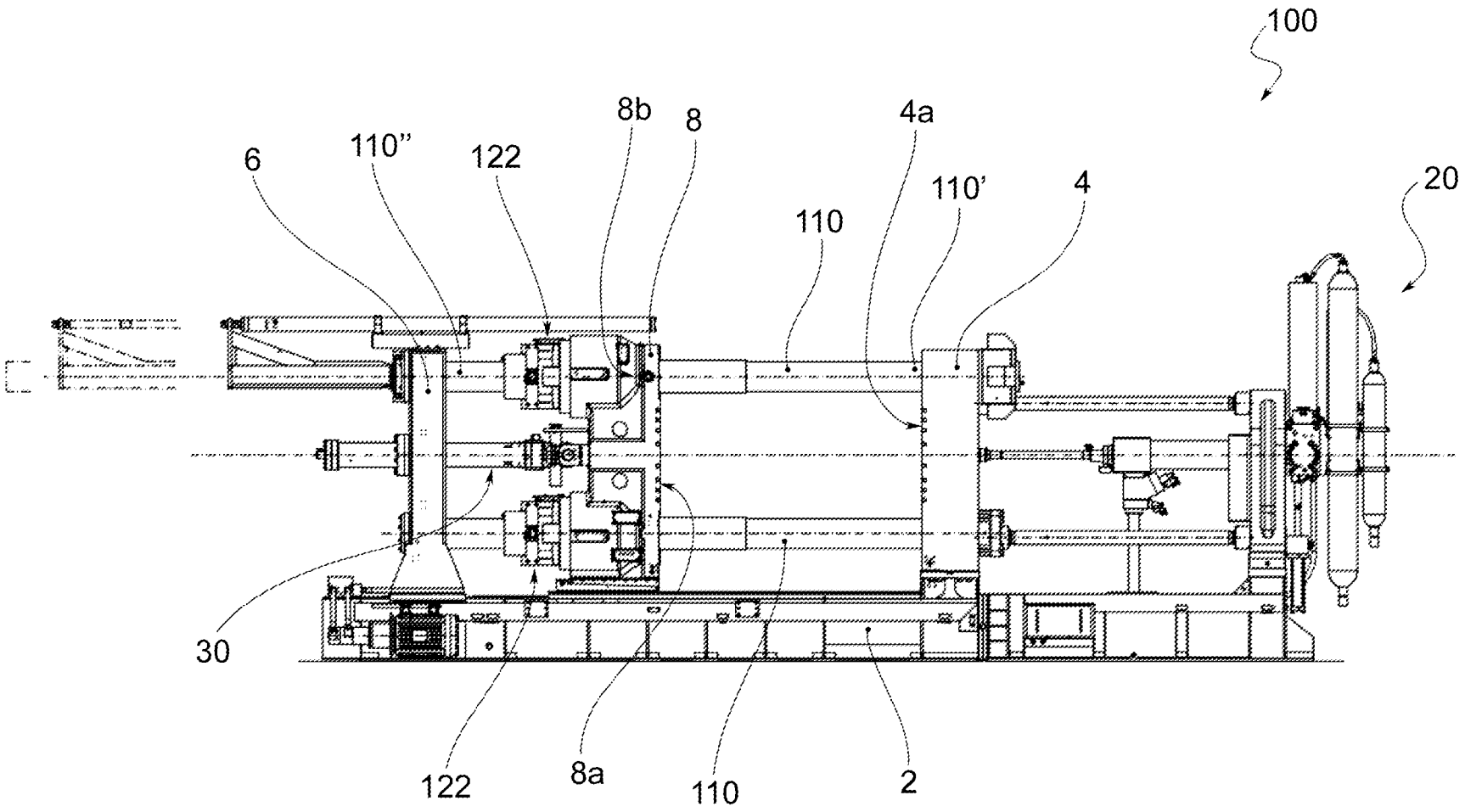
FIG. 8 shows a toggle-free die-casting machine according to a further aspect of the present invention.

With reference to FIG. 8, according to a further aspect of the invention, a toggle-free die-casting machine 100 has structural and functional features similar to those of the machine with toggle described above but includes clamping jaws 122 for clamping the movable plane 8 in the engagement position with the first fixed plane 4 in which the die is closed.

Preferably, the clamping jaws 122 are supported by the movable plane 8 and in particular are applied to an outer face 8*b* of the movable plane 8; preferably, moreover, said clamping jaws 122 are actuated by means of actuators, for example hydraulic actuators.

Figure 9:
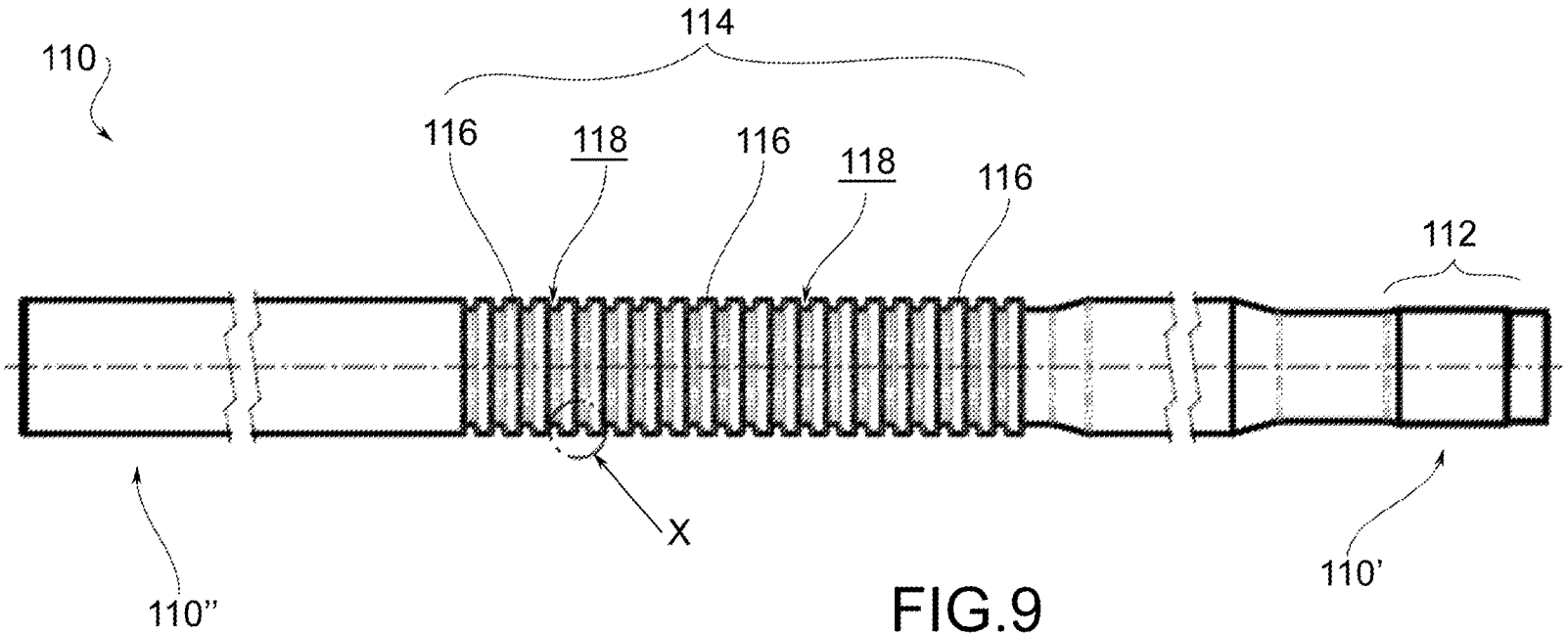
FIG. 9 depicts a column from the machine in FIG. 8.
Figure 10:
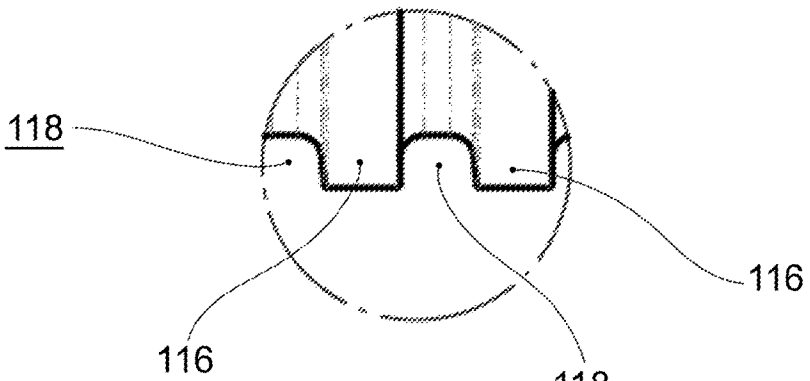
FIG. 10 is an enlargement of the box X in FIG. 9, showing a profile of an intermediate section of the horizontal column.

In said embodiment (FIG. 9), each horizontal column 110 extends longitudinally along a respective column axis X between a first end 110', secured to the first fixed plane 4, and a second end 110", supported by the second fixed plane 6.

At the first end 110', the horizontal column 110 has a shaped section 112 made as described above for the shaped section 12 of the horizontal columns 10 of the machine with toggle.

Further, according to the above-described variants, on said shaped section 112, the connecting device operates to connect the first end 110' of the column 110 to the first fixed plane 4.

Further, each horizontal column 110, at an intermediate position between the first end 110' and the second end 110", has an intermediate shaped section 114 on which the clamping jaws 122 are forcibly tightened to close the die by radial clamping.

Each intermediate shaped section 114 comprises a plurality of protruding, intermediate circumferential ribs 116 spaced longitudinally to form respective intermediate circumferential grooves 118.

According to a further variant of the invention, the shaped section with ribs and grooves as described above is provided at the second end 110" of the column 110 for connecting the column 110 to the second fixed plane 6. In said embodiment, the connecting device according to the embodiments described above actuates the connection between the second end 110" of the column 110 and the second fixed plane 6.

Innovatively, the above-described invention meets the reliability requirements of the industry and overcomes the drawbacks discussed above, in that it is possible to make shaped sections with ribs and grooves that are much stronger than the threaded sections used in known solutions.

Advantageously, the invention allows for a more simplified connection between the column and the fixed plane, since, unlike conventional columns with threads, it does not require the column to be phased. This is a significant advantage especially for automated applications wherein the half shells close by means of hydraulic cylinders.

According to a further advantageous aspect, the grooves according to the invention are made by means of simpler machining operations than those required to make a thread; this allows tighter tolerances to be met, both for the shaped section of the column and for the corresponding region of the half-shells, drastically reducing the play between the coupled surfaces.

This aspect also has a considerable impact on the reliability of the machine, since the columns, during normal machine operation, are subject to a tensile load with cyclic inversion of the direction and the absence or drastic reduction of play producing a significant improvement in fatigue behavior.

Advantageously, the connecting device achieves effective column restraint. Advantageously, in fact, when the column is subjected to tensile loads along the column axis, the circumferential ribs unload axial forces onto the half-shells, particularly through contact with the lateral sides. Consequently, the two half-shells are subject to thrusts in the radial direction, orthogonal to the column axis, which would tend to push them away from each other. However, also due to the tangential screws that join the two half-shells together, said radial movements of the half-shells are prevented simply and effectively, further minimizing play.

Advantageously, the profile of the grooves allows for a compromise to be reached between the dimensional and coupling tolerances of the half-shells and for the forces in the radial direction that are generated when the column is subjected to tensile loads to be minimized. Specifically, in fact, high angles of inclination of the lateral sides of the ribs would result in radial thrusts that are too high; conversely, moderate angles of inclination would require particularly stringent dimensional and coupling tolerances between the half-shells and the shaped section.

It is clear that a person skilled in the art, in order to satisfy contingent needs, could make modifications to the die-casting machine described above, said modifications all being contained within the scope of protection as defined in the following claims.

The invention claimed is:

1. A die-casting machine comprising a first fixed vertical plane supporting a fixed half-die, a second fixed vertical plane longitudinally spaced apart from the first fixed vertical plane, a movable vertical plane carrying a movable half-die, placed between the first and second fixed vertical planes and horizontally translatable on command towards the first fixed vertical plane for coupling the fixed half-die and the movable half-die, and horizontal columns, wherein each horizontal column extends longitudinally along a respective column axis between a first end secured to the first fixed vertical plane, and a second end, secured to the second fixed vertical plane, and slidably supporting the movable vertical plane, wherein, at said first end, the horizontal column has a shaped section for connection to the first fixed vertical plane, the shaped section comprising a plurality of circumferential ribs radially projecting and axially spaced apart, interspersed with grooves, wherein, for each horizontal column, the die-casting machine comprises a connecting device adapted to be rigidly coupled to the shaped section of the horizontal column, forming an abutment that opposes an extraction of the horizontal column from the first fixed vertical plane, said connecting device comprising a shell rigidly coupled with shape coupling to the shaped section of the horizontal column, wherein the shell consists of two half-shells, each in the form of a hollow half-cylinder, coupled together by a plurality of tangential screws, wherein each groove of the shaped section has a substantially trapezoidal profile, wherein said substantially trapezoidal profile has a first side consisting of a truncated cone surface coaxial with the column axis, a groove bottom consisting of a cylindrical surface coaxial with the column axis and a second side consisting of a further truncated cone surface coaxial with the column axis, so that said first and second sides converge towards the column axis, and wherein each side of the substantially trapezoidal profile is inclined with respect to a direction transverse to the column axis by an angle between 6 and 16 degrees.

2. The die-casting machine of claim 1, wherein each side of the substantially trapezoidal profile is inclined with respect to the direction transverse to the column axis by an angle between 8 and 14 degrees.

3. The die-casting machine of claim 1, wherein each side of the substantially trapezoidal profile is inclined with respect to the direction transverse to the column axis by an angle equal to 10 degrees.

4. The die-casting machine of claim 1, wherein the first side and the second side are joined to the groove bottom.

5. The die-casting machine of claim 1, wherein each circumferential rib of the plurality of circumferential ribs has a ridge consisting of a cylindrical circular surface, coaxial with the column axis.

6. The die-casting machine of claim 1, wherein the connecting device comprises a main plate applied in abutment to the first end of the horizontal column and to the shell.

7. The die-casting machine of claim 6, wherein the main plate is secured by screws directly to the first fixed vertical plane and further secured by screws to the shell, the shell not being directly secured to the first fixed vertical plane.

8. The die-casting machine of claim 7, wherein the shell is secured, by screws, directly to the first fixed vertical plane and the main plate is secured, by screws, to the shell.

9. The die-casting machine of claim 1, wherein the connecting device comprises at least one jaw fluidly operable and secured to the shell, the at least one jaw comprising at least one piston for acting in thrust on a corresponding half-shell.

10. The die-casting machine of claim 1, wherein the connecting device is manually operated.

* * * * *